US005450892A

United States Patent [19]

Gautreaux, Jr.

[11] Patent Number: 5,450,892

[45] Date of Patent: Sep. 19, 1995

[54] ALKALINE SCRUBBER FOR CONDENSATE STRIPPER OFF-GASES

[75] Inventor: Wilson T. Gautreaux, Jr., Mt. Pleasant, S.C.

[73] Assignee: AlliedSignal Inc., Morris Township, N.J.

[21] Appl. No.: 38,539

[22] Filed: Mar. 29, 1993

[51] Int. Cl.[6] ..... D21C 11/06

[52] U.S. Cl. ..... 162/16; 162/29; 162/30.1; 162/51; 159/47.3; 203/92; 423/233; 423/234

[58] Field of Search ..... 423/233, 234, 245.2; 162/29, 30.1, 16, 51, 68; 159/47.3, 16.3; 203/91, 92

[56] References Cited

U.S. PATENT DOCUMENTS

| | | | |
|---|---|---|---|
| 2,747,962 | 5/1956 | Heitz et al. | 23/2 |
| 4,137,134 | 1/1979 | Suominen et al. | 162/16 |
| 4,417,075 | 11/1983 | Stogryn | 423/223 |
| 4,431,617 | 2/1984 | Farin | 162/36 |
| 4,649,032 | 3/1987 | Snavely, Jr. et al. | 423/229 |
| 4,872,950 | 10/1989 | Andersson et al. | 162/15 |

OTHER PUBLICATIONS

I. B. Douglass et al., "A Study of Methyl Mercaptan and Dimethyl Sulfide Formation in Kraft Pulping," *TAPPI*, vol. 49, No. 8 (Aug. 1966).

T. T. C. Shih et al., "Methyl Mercaptan Vapor-Liquid Equilibrium in Aqueous Systems as a Function of Temperature and pH," *TAPPI*, vol. 50, No. 12 (Dec. 1967).

A. H. Nissan, *Basic Principles of Pulp and Paper* (1984).

R. W. Rousseau et al., "Analyzing Chemical Absorbers and Strippers," *Chemical Engineering* (Jul. 18, 1988).

K. Ellis, *Ring Formation in a NCG Burning Lime Kiln*, a paper presented at the 1989 Environmental Conference.

Y. Hwang et al., "Steam Stripping for Removal of Organic Pollutants from Water. 1. Stripping Effectiveness and Stripper Design," *Ind. Eng. Chem. Res.*, vol. 31 (1992).

Y. Hwang et al., "Steam Stripping for Removal of Organic Pollutants from Water. 2. Vapor-Liquid Equilibrium Data," *Ind. Eng. Chem. Res.*, vol. 31 (1992).

S. Q. Hassan et al., "Steam Stripping and Batch Distillation for the Removal and/or Recovery of Volatile Organic Compounds . . . ," *J. Air Waste Manage. Assoc.*, vol. 42 (1992).

B. J. Skrifvars et al., *Chemical Reaction Sintering as a Cause for Lime Kiln Rings*, a paper presented at the 1992 International Chemical Recovery Conference.

H. Tran et al., *Mechanisms of Ring Formation in Lime Kilns*, a paper presented at the 1992 International Chemical Recovery Conference.

Arvi Ronnholm, "Steam Stripping removes BOD Compounds from Condensate of Cont. Pulp Mill", Pulp & Paper Int., Feb. 1974, pp. 45–49.

*Primary Examiner*—Peter Chin
*Assistant Examiner*—Dean T. Nguyen
*Attorney, Agent, or Firm*—Jerry J. Holden; James W. McFarland

[57] ABSTRACT

This invention relates to an alkaline scrubber for condensate stripper off-gases. In particular, this invention relates a process for selectively removing hydrogen sulfide and methyl mercaptan from a gas stream containing these compounds and methanol. Such gas streams are commonly generated during pulp and paper production.

18 Claims, 2 Drawing Sheets

SCHEMATIC OF COUNTERCURRENT SCRUBBER FOR CONDENSATE OFF-GASES

SCHEMATIC OF COUNTERCURRENT SCRUBBER FOR CONDENSATE OFF-GASES

SCHEMATIC OF CO-CURRENT SCRUBBER FOR CONDENSATE OFF-GASES

ALKALINE SCRUBBER FOR CONDENSATE STRIPPER OFF-GASES

FIELD OF INVENTION

This invention relates to an alkaline scrubber for condensate stripper off-gases. In particular, this invention relates a process for selectively removing hydrogen sulfide and methyl mercaptan from a gas stream containing these compounds and methanol. Such gas streams are commonly generated during pulp and paper production.

BACKGROUND OF THE INVENTION

As part of the paper-making process, wood chips are disintegrated via the combined actions of alkali white liquor and a digesting machine to yield wood pulp and black liquor. The wood pulp, after being washed to remove the black liquor, is used to produce paper. The now diluted black liquor (containing about 12 to 15% solids) is processed through a multiple-effect evaporator to increase the solids level of the black liquor (to about 45 to 50%). This evaporation of the black liquor results in the generation of foul condensates. These foul condensates are subjected to a steam-stripping process which generates off-gases containing various contaminants. The disposal of such condensate stripper off-gases presents a major problem for the paper industry.

Off-gases contain methanol ($CH_3OH$) as well as total reduced sulfur (TRS) gases such as hydrogen sulfide ($H_2S$), methyl mercaptan ($CH_4S$), dimethyl sulfide [$(CH_3)_2S$], and dimethyl disulfide [$(CH_3)_2S_2$]. Unlike dimethyl sulfide and dimethyl disulfide, hydrogen sulfide and methyl mercaptan are weak acids that readily ionize in alkaline solutions to form nonvolatile species. As hydrogen sulfide and methyl mercaptan are classified as being hazardous compounds, their emissions must be reported to the under the Comprehensive Environmental Response and Compensation Liability Act (CERCLA). Several states have passed similar regulations requiring mills to both limit and report emissions of these compounds.

Recent federal regulations have also impacted how paper mills handle the methanol contained in condensate stripper off-gases. It was standard practice in the industry to produce liquid condensate mixtures of methanol and water (from the steam-stripping of the foul condensates) at concentration levels of about 50:50 wt. %. However, hazardous waste regulations now classify such liquids (i.e., liquids having a flash point of less than 140° F.) as being a hazard. Thus, any paper mill which generates a liquid mixture of methanol and water having a flash point of less than 140° F. becomes a hazardous waste generator under federal law.

To avoid becoming a hazardous waste generator at least one paper mill produces liquid condensates from the steam-stripping process having flash points greater than 140° F. This is accomplished by increasing the amount of water contained in the liquid condensate to a level of about 70 wt % or more. As the resulting methanol levels contained in these liquid condensate mixtures are too low to be economically incinerated, the mixtures are sewered. Disposal of methanol in this manner adds a significant biological oxygen demand (BOD) load on the mill's waste treatment plants.

For environmental reasons, it is standard industry practice to incinerate the off-gases generated by the steam-stripping of the foul condensates. Historically such incinerations have been performed in one of three ways. The first method is to directly feed the condensate stripper off-gas stream into a lime kiln for incineration prior to release into the atmosphere. This method results in the removal of about 95% of the sulfur contained in the TRS gases. However, about 5% of the sulfur is released into the atmosphere as sulfur dioxide ($SO_2$). Thus, direct incineration may not be environmentally feasible for areas under severe sulfur dioxide emission restrictions. An additional problem inherent with this method is ring formation in the lime kilns caused by burning these TRS gases.

The second method used by industry to incinerate the off-gas stream is a variation of the method noted above. The stream is again directly fed into a lime kiln, but the kiln exhaust is sent into a scrubber where caustic is used to remove the sulfur dioxide prior to release into the atmosphere. Although this method greatly reduces the problem of atmospheric sulfur dioxide venting, it does not address the problem of lime kiln ring formation. Furthermore, the system is relatively expensive to implement and operate.

The third method used by industry is to direct the off-gas stream into a dedicated incinerator. After incineration, the stream is sent through a scrubber where caustic is used to remove the $SO_2$ before release into the atmosphere. While this method both avoids the ring formation problem and greatly reduces the atmospheric release of $SO_2$, it is also the most expensive of the three methods—requiring capital outlays for an dedicated incinerator and a scrubber as well as their subsequent operating costs.

Therefore, it is the object of this invention to provide an improved economical process for disposal of condensate stripper off-gases. Other objects, features, and advantages will be evident from the following disclosure.

SUMMARY OF THE INVENTION

The object of this invention is met by a process of passing condensate stripper off-gases through a novel alkaline scrubber designed to both selectively remove TRS compounds and to allow most of the methanol to remain in the scrubbed gases (which are subsequently incinerated). To enhance the selective removal of TRS, the absorber has several unique characteristics.

First, the number of stages contained in the scrubber are minimized. Very few stages are required to remove the TRS compounds because chemical reactions between these compounds and the scrubbing alkaline compounds in the liquid enhances removal of the TRS. However, methanol absorption is inhibited by the alkaline compounds. Thus, additional scrubber stages from the minimum necessary to remove the TRS are required for adequate methanol absorption. It has been found that the optimum number of stages for this process is either 3 or 4.

Second, the temperature of the liquid contained in the scrubber is elevated to a preferred temperature of about 212° F. to reduce methanol absorption. Although higher temperatures may be employed, such temperatures also require that higher pressures be used. These temperatures have little effect on TRS absorption because the chemical reactions are only slightly affected.

Third, the flow of the scrubbing alkaline liquid is minimized to provide sufficient alkaline compounds for TRS reaction, but little for methanol absorption. That is, the liquid flow rate is low relative to the flow rate of the condensate stripper off-gas steam.

Fourth, the process allows about 70–80% of the methanol to be retained in the scrubbed gases. This relieves a significant BOD load on waste treatment plants while providing a source of fuel for the incineration of the scrubbed gases.

Fifth, the process has a further environmental advantage in the event of a shutdown of the incinerator or lime kiln which burns the scrubbed gases. In these cases the process can be quickly adjusted to minimize the release of methanol and TRS gases into the atmosphere.

Finally, while the above advantages apply to both conventional countercurrent flow scrubbers and unconventional co-current flow scrubbers, co-current flow absorbers are preferred. By employing a co-current flow design the driving forces for methanol absorption are reduced and TRS absorption is slightly enhanced. A further advantage is the lower pressure drop associated with a co-current flow.

This process is most applicable to treating condensate stripper off-gases in the paper industry. However, the process is generally applicable to selective absorption of acidic gases from gases containing nonreactive organics.

BRIEF DESCRIPTION OF THE DRAWINGS

The objects of the present invention will become more apparent and the invention will be better understood from the following description of the preferred embodiments taken together with the accompanying drawings.

DESCRIPTION OF THE PREFERRED EMBODIMENTS

Figure 1:
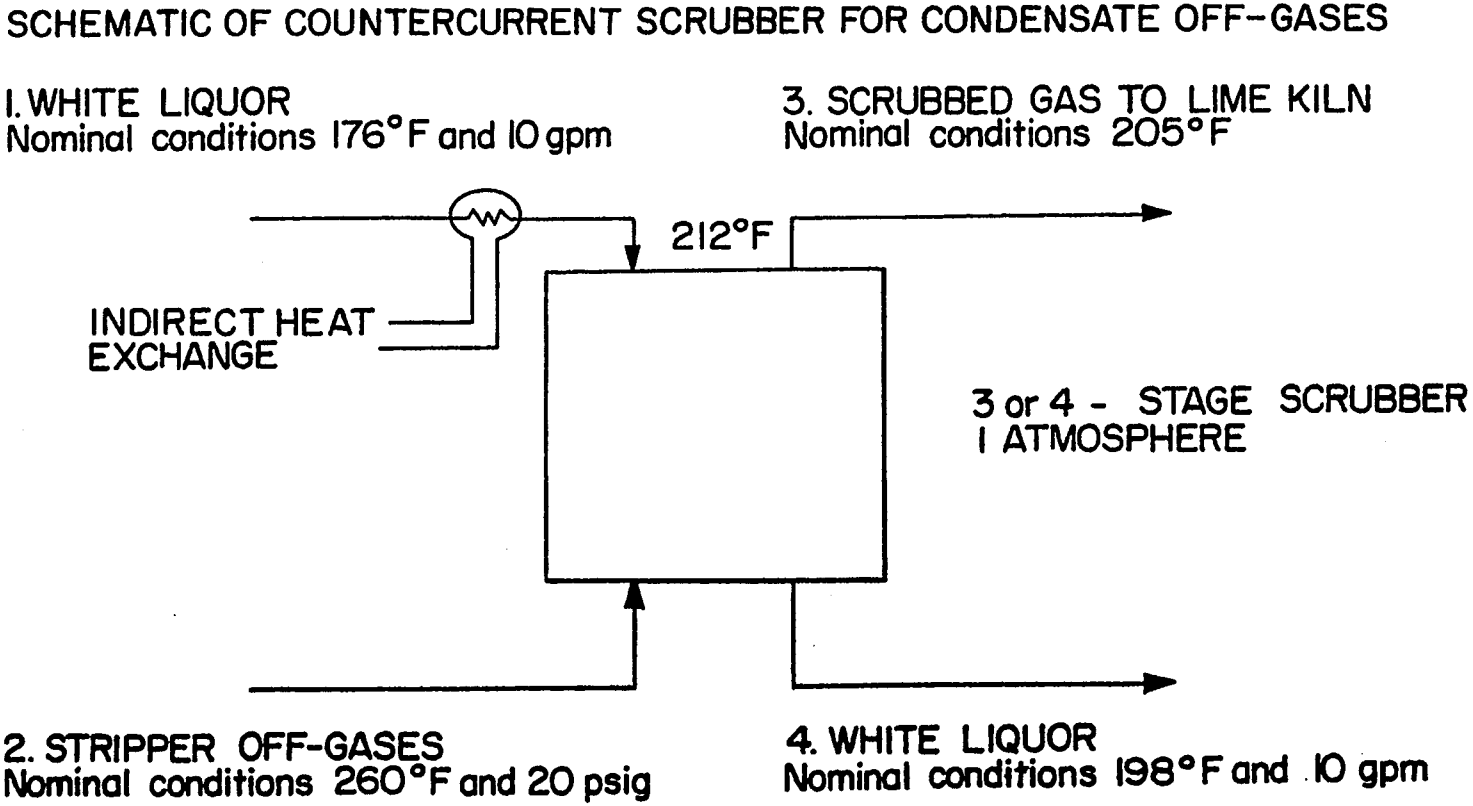
FIG. 1 is a diagrammatic flow plan of a countercurrent TRS scrubber for condensate stripper off-gases. The scrubber may be employed commercially to selectively remove TRS compounds from the scrubber gas stream while also allowing most of the methanol to remain in the stream (which is subsequently incinerated).
Figure 2:
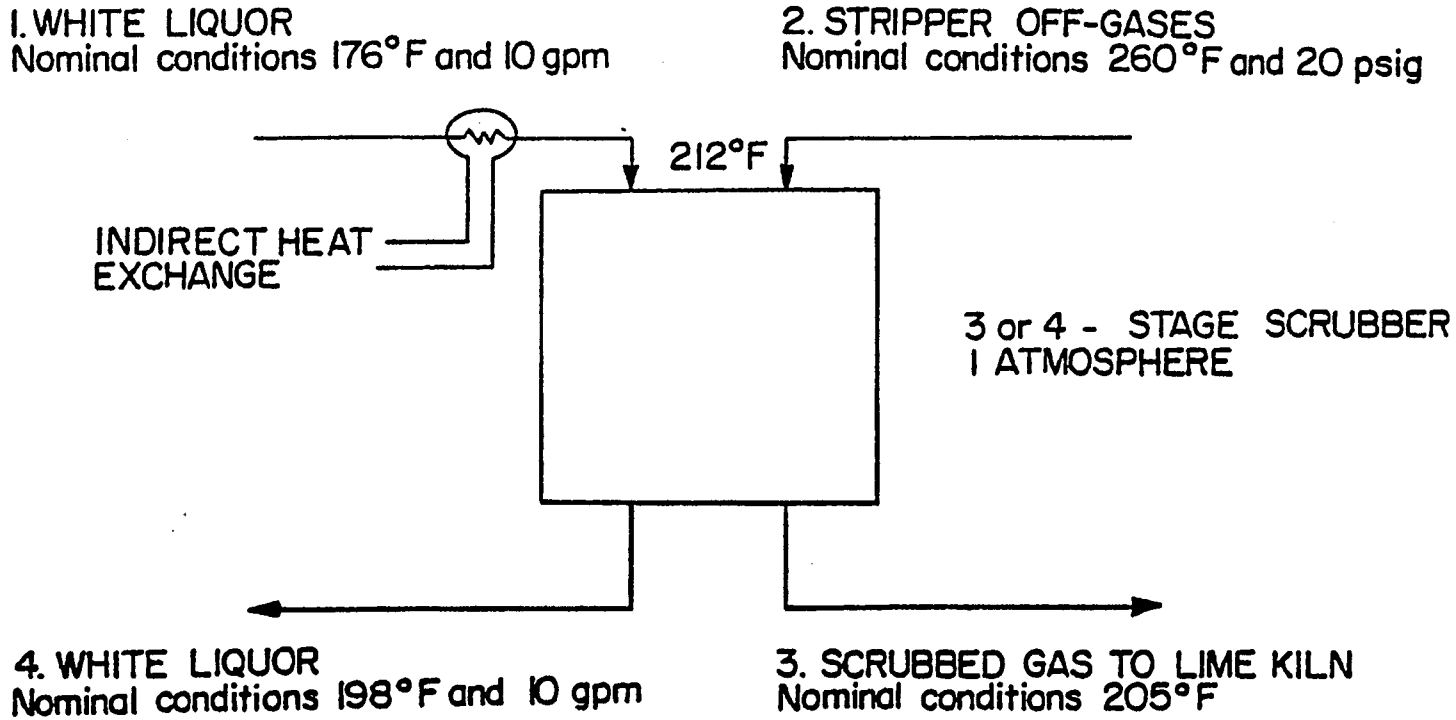
FIG. 2 is a diagrammatic flow plan of a co-current TRS scrubber for condensate stripper off-gases. The scrubber may be employed commercially to selectively remove TRS compounds from the scrubber gas stream while also allowing most of the methanol to remain in the stream (which is subsequently incinerated).

The general process for selectively removing TRS gases from a methanol-containing gas stream is as follows. As shown in the Figures above, a white liquor (or other alkaline liquid) stream (1) passed through a scrubber unit. A stream containing the condensate stripper off-gases (2) is also passed through the scrubber unit. The off-gas stream may pass through the scrubber either counter-currently (FIG. 1) or co-currently (FIG. 2) to the white liquor stream. The enriched white liquor is removed (4) and recirculated for use in the papermaking process, while the methanol-enriched scrubbed gas stream (3) is vented for incineration (usually in a lime kiln).

Common off-gas stream components and their physical properties are listed in Table I below. The operation of the generating steam-stripper as well as other factors can vary the concentrations of the off-gas stream components. However, the scrubber system will function to selectively remove the methanol, hydrogen sulfide, and methyl mercaptan contained in the stream regardless of the concentration of these components.

TABLE I

| OFF-GAS STREAM | | | |
|---|---|---|---|
| Component | Formula | Boiling Point (°C.) | Concentration (mol %) |
| Water | $H_2O$ | 100 | 52 |
| Methanol | $CH_3OH$ | 65 | 40 |
| Hydrogen Sulfide | $H_2S$ | −62 | 4 |
| Methyl Mercaptan | $CH_4S$ | 6 | 4 |

As noted above, white liquor is commonly utilized in paper mills for pulping purposes. The standard components of a white liquor are listed in Table II below.

TABLE II

| WHITE LIQUOR STREAM | | |
|---|---|---|
| Component | Formula | Concentration (molar) |
| Sodium Hydroxide | $NaOH$ | 2.0 |
| Sodium Sulfide | $Na_2S$ | 0.6 |
| Sodium Carbonate | $Na_2CO_3$ | 0.3 |

In order to practice this process, it is necessary to have sodium hydroxide in the scrubbing alkaline liquid at a molar concentration level in the range of about 1–5; with the preferred molar concentration level being about 4. Increasing the level of sodium hydroxide both increases the methanol and decreases the water contained in the stripped gas stream. As noted in Table II above, the standard molar concentration level of sodium hydroxide in white liquor is 2. Therefore, when white liquor is employed it is preferred to add sodium hydroxide to the white liquor prior the stream being introduced into the scrubber.

Any liquid alkali mixture having a pH of at least 12 which also contains a sufficient concentration of sodium hydroxide may be utilized in the process. However, it is preferred to use white liquor as the scrubbing alkaline liquid agent.

The primary reactions occurring in the liquid phase of the scrubber between the hydrogen sulfide and methyl mercaptan components of the off-gas stream and the sodium hydroxide contained in the white liquor stream are listed in Table III below.

TABLE III

| Reactions in the Liquid Phase: |
|---|
| $H_2S + 2NaOH \rightarrow Na_2S + 2H_2O$ |
| $CH_4S + NaOH \rightarrow CH_3SNa + H_2O$ |

The $Na_2S$ and the $CH_3SNa$ reaction products formed in the liquid phase have extremely high boiling points and are non-volatile. Thus, this process greatly reduces the odor problem associated with TRS gases. Furthermore, the process produces $Na_2S$ from the off-gas stream to enrich the white liquor stream exiting from the scrubber unit (which is recycled for use in digesting wood chips).

The neutral sulfur compounds in the TRS gases (dimethyl sulfide and dimethyl disulfide) are not removed via reaction with the alkaline liquid. However, the small levels of these compounds which are not consumed by the subsequent incineration of the scrubbed gas stream are insufficient to cause ring formation in lime kilns.

As noted above, the flow rate of the alkaline liquid stream must be low relative to the flow rate of the stripper off-gas stream. The key is to provide sufficient alkaline compounds for TRS reaction while at the same time minimizing methanol absorption.

To practice this process it is necessary that the molar flow rates of the alkaline liquid (or white liquor) stream and the stripper off-gas stream be proportional to each other at a ratio of between 2:1 to 10:1; with the preferred ratio being about 4:1. The normal physical flow rate for the alkaline liquid stream is between 5–20 gallons per minute (gpm); with a preferred rate of about 10 gpm.

The temperature of the stripper off-gas stream is in the range of 212°–280° F.; with the preferred temperature being about 260° F.

The temperature of the alkaline liquid stream is important, in that if the temperature of the stream is too low, unacceptably high methanol absorption into the alkaline liquid stream occurs. Likewise, if the temperature of the stream is too high, an unacceptably high amount of water is carried over with the scrubbed gases into the lime kiln (which can cause ring formation). The normal operating temperature of the white liquor stream is in the range of 160°–210° F., with the usual temperature being about 176° F. While the white liquor (or alkaline liquid) stream will function in the process at this temperature, it is preferred to adjust the temperature of the white liquor (or alkaline liquid) stream to a range of 180°–212° F. by means of indirect heat exchange prior to the stream entering the scrubber under normal operating procedures.

As noted above, the process has a further environmental advantage of being able to minimize the release of methanol and TRS gases into the atmosphere under certain abnormal conditions. For example, normal operating conditions for the alkaline liquid stream (high temperature and low flow rate) minimize the absorption of methanol into the alkaline liquid stream while maximizing the methanol contained in the scrubbed gas stream which is subsequently incinerated. However, should the lime kiln for some reason fail to incinerate the scrubbed gas stream, the methanol and TRS gases contained in the stream would be vented into the atmosphere. Under such abnormal conditions one would utilize the means for indirect heat exchange to cool the alkaline liquid stream to a temperature below 160° F. prior to its entry into the scrubber, while also increasing the flow rate of the stream to about 50 gpm. These abnormal operating conditions for the alkaline liquid stream (low temperature and high flow rate) maximize the absorption of methanol and TRS gases into the alkaline liquid stream while minimizing the methanol and TRS gases contained in the scrubbed gas stream (which would be vented without incineration into the atmosphere).

The number of stages contained in the scrubber unit may be either 3 or 4, depending upon the needs of the user. An increase in stages from 3 to 4 results in a lowering of both the amount of TRS gases lost overhead and the amount of methanol recovered.

The following examples are provided to further illustrate the present invention and are not to be construed as limiting the invention in any manner.

EXAMPLES

A commissioned software computer program was purchased from OLI Systems, Inc. of Morris Plains, New Jersey, for use in evaluating different scrubber models. For accurate simulation of the scrubbers, the fundamental step was to have accurate representations of the vapor-liquid-equilibrium (VLE) phase behaviors for binary methyl mercaptan-water, methanol-water, and hydrogen sulfide-water systems.

The data contained in the paper by T. T. C. Shih et al. entitled "Methyl Mercaptan Vapor-Liquid Equilibrium in Aqueous Systems as a Function of Temperature and pH", TAPPI, 50 (12), 634 (1967), was used to accurately predict the VLE phase for the methyl mercaptan-water system. The dissociation of aqueous methyl mercaptan was also included in the chemistry model. The dissociation constant of this reaction was taken from the paper by Shih et al.

As methanol is highly soluble in water only data concerning methanol mole fractions less than 0.25 were used to obtain vapor-liquid partitioning coefficients for methanol. The paper by J. Gmehling et al. entitled "Vapor-Liquid-Equilibrium Data Collection", *Dechema*, Vol. I, part 1, Frankfurt, W. Germany (1977), was consulted for much of this raw data. VLE data with pressures as high as 5 bar were accurately reproduced.

Various data on the thermodynamic properties for hydrogen sulfide was used for formulating the hydrogen sulfide-water system.

Thermodynamic properties obtained for methyl mercaptan and methanol in this work have been used for the simulation of the scrubber. A density of 1.0 for the white liquor was used in calculating the molar flow rates of each input component.

Table IV below summarizes the various computer runs and their purposes. Table V below summarizes the results obtained from the computer simulations.

TABLE IV

| Run | Purpose |
|---|---|
| 1 | Base Case |
| 2 | Effect of Increasing Number of Stages |
| 3 | Effect of Increasing Feed Temperature for White Liquor |
| 4 | Effect of Decreasing White Liquor Feed Rate |
| 5 | Effect of Adjusting White Liquor Feed Rate to Meet Spec on Methanol in Overhead |
| 6[1] | Effect of Lowering Tower Pressure |
| 7[2] | Effect of Increasing the NaOH Concentration in the White Liquor From 2.0 to 3.0 Molar |
| 8[2] | Effect of Adjusting White Liquor Feed Rate to Most Spec on Methanol in Overhead When NaOH Concentration in White Liquor is 3.0 Molar |

1. In case 6, the use of a lower tower pressure had a positive effect on methanol retention. However, the amount of methyl mercaptan contained in the scrubbed gas stream was increased.

2. In cases 7 and 8, increasing the amount of sodium hydroxide contained in the white liquor allowed one to dramatically increase the methanol contained in the scrubbed gas stream while also keeping TRS gas levels low.

TABLE V

| RUN | White GMP | Liquor T (°C.) | NaOH (molar) | No. of Stages | Tower P (atm) | Overhead (gmoles/hr) $CH_4S$ | $H_2S$ | MeOH | % Retained Methanol |
|---|---|---|---|---|---|---|---|---|---|
| 1 | 29.0 | 100.0 | 2.0 | 3 | 1.0 | 1.37 | 0.01 | 6636.9 | 62 |
| 2 | 29.0 | 100.0 | 2.0 | 4 | 1.0 | 0.12 | 0.01 | 6478.0 | 61 |
| 3 | 20.0 | 120.0 | 2.0 | 4 | 1.0 | 0.17 | 0.01 | 6800.4 | 66 |
| 4 | 10.0 | 100.0 | 2.0 | 4 | 1.0 | 2.77 | 0.01 | 8162.3 | 77 |
| 5 | 4.82 | 100.0 | 2.0 | 4 | 1.0 | 643.50 | 0.03 | 9000.0 | 85 |
| 6 | 20.0 | 100.0 | 2.0 | 3 | 0.5 | 0.53 | 0.01 | 7215.6 | 68 |

TABLE V-continued

| RUN | White GMP | Liquor T (°C.) | NaOH (molar) | No. of Stages | Tower P (atm) | Overhead (gmoles/hr) $CH_4S$ | $H_2S$ | MeOH | % Retained Methanol |
|---|---|---|---|---|---|---|---|---|---|
| 7 | 20.0 | 100.0 | 3.0 | 3 | 1.0 | 0.34 | 0.004 | 8103.6 | 76 |
| 8 | 11.5 | 100.0 | 3.0 | 4 | 1.0 | 0.18 | 0.003 | 9000.0 | 85 |

The results listed in the above table clearly indicate that the scrubbing process is successful over a wide range of conditions.

Many modifications and variations of the present invention will be apparent to one of ordinary skill in the art in light of the above teachings. It is therefore understood that the scope of the invention is not to be limited by the foregoing description, but rather is to be defined by the claims appended hereto.

What is claimed is:

1. A process for selectively removing hydrogen sulfide and methyl mercaptan from a gas stream containing and methanol, which comprises:

(a) passing an alkaline liquid stream having:

1) a pH level of at least 12, 2) a temperature in the range of 160°–212° F., and 3) a sodium hydroxide content at a molar concentration in the range of 1–5, through a scrubber unit having 3 or 4 stages at a flow rate in the range of 5–20 gallons per minute;

(b) passing said gas stream at a temperature in the range of 212°–280° F. through the scrubber unit in a countercurrent direction to the flow of the alkaline liquid stream, with the molar flow rate of the gas stream at a rate proportional to the alkaline liquid stream at a ratio in the range of 2:1 to 10:1, wherein the gas stream existing the scrubber unit contains 20–30% less methanol than said gas stream entering the scrubber unit, and (c) wherein upon exiting the scrubber unit, the gas stream is incinerated.

2. The process of claim 1 wherein said gas stream is produced by steam-stripping foul condensates generated from the evaporation of black liquor produced during the production of pulp and paper.

3. The process of claim 1 wherein said alkaline liquid stream is passed through a means for indirect heat exchange capable of both heating and cooling the alkaline liquid stream prior to the alkaline liquid stream entering the scrubber unit.

4. The process of claim 1 wherein the flow rate for the alkaline liquid stream is in the range of 8–12 gallons per minute.

5. The process of claim 1 wherein the molar concentration of sodium hydroxide contained in the alkaline liquid stream is about four.

6. The process of claim 1 wherein the alkaline liquid stream is white liquor.

7. The process of claim 6 wherein the white liquor stream, upon exiting the scrubber unit, is recycled for use in the production of pulp and paper.

8. The process of claim 1 wherein the temperature of the alkaline liquid stream in the scrubber unit is about 212° F.

9. The process of claim 1 wherein upon exiting the scrubber unit, the gas stream is incinerated in a lime kiln.

10. A process for selectively removing hydrogen sulfide and methyl mercaptan from a gas stream containing hydrogen sulfide, methyl mercaptan, and methanol, which comprises:

(a) passing an alkaline liquid stream having:

1) a pH level of at least 12, 2) a temperature in the range of 160°–212° F., and 3) a sodium hydroxide content at a molar concentration in the range of 1–5, through a scrubber unit having 3 or 4 stages at a flow rate in the range of 5–20 gallons per minute;

(b) passing said gas stream at a temperature in the range of 212°–280° F. through the scrubber unit in a co-current direction to the flow of the alkaline liquid stream, with the molar flow rate of the gas stream at a rate proportional to the alkaline liquid stream at a ratio in the range of 2:1 to 10:1, wherein the gas stream existing the scrubber unit contains 20–30% less methanol than said gas stream entering the scrubber unit; and (c) wherein upon exiting the scrubber unit, the gas stream is incinerated.

11. The process of claim 10 wherein said gas stream is produced by steam-stripping foul condensates generated from the evaporation of black liquor produced during the production of pulp and paper.

12. The process of claims 10 wherein said alkaline liquid stream is passed through a means for indirect heat exchange capable of both heating and cooling the alkaline liquid stream prior to the alkaline liquid stream entering the scrubber unit.

13. The process of claim 10 wherein the flow rate for the alkaline liquid stream is in the range of 8–12 gallons per minute.

14. The process of claim 10 wherein the molar concentration of sodium hydroxide contained in the alkaline liquid stream is about four.

15. The process of claim 10 wherein the alkaline liquid stream is white liquor.

16. The process of claim 15 wherein the white liquor stream, upon exiting the scrubber unit, is recycled for use in the production of pulp and paper.

17. The process of claim 10 wherein the temperature of the alkaline liquid stream in the scrubber unit is about 212° F.

18. The process of claim 10 wherein upon exiting the scrubber unit, the gas stream is incinerated in a lime kiln.

* * * * *

UNITED STATES PATENT AND TRADEMARK OFFICE
CERTIFICATE OF CORRECTION

PATENT NO. : 5,450,892
DATED : September 19, 1995
INVENTOR(S) : Wilson T. Gautreaux, Jr.

It is certified that errors appear in the above-identified patent and that said Letters Patent is hereby corrected as shown below:

On the title page, under Assignee, delete "AlliedSignal Inc.,Morris Township, N.J. and substitute therefor --Westvaco Corporation, New York, NY--.

On the title page, under Attorney, Agent, or Firm, delete "Jerry J. Holden; James W. McFarland" and substitute therefor --Daniel B. Reece IV; Terry B. McDaniel, Richard L. Schmalz--.

In column 6, line 50, in Table IV, delete "Most" and substitute therefor --Meet--.

In column 6, Table V, in the first row, second column, under White GMP, delete "29.0" and substitute therefor --20.0--.

In column 6, Table V, in the second row, second column, under White GMP, delete "29.0", and substitute therefor --20.0--.

In column 6, Table V, in the third row, last column, under % Retained Methanol, delete "66", and substitute therefor --64--.

In column 7, line 23, after the word containing, insert --hydrogen sulfide, methyl mercaptan--.

UNITED STATES PATENT AND TRADEMARK OFFICE
CERTIFICATE OF CORRECTION

PATENT NO. : 5,450,892 
DATED : September 19, 1995
INVENTOR(S) : Wilson T. Gautreaux, Jr.

It is certified that errors appear in the above-identified patent and that said Letters Patent is hereby corrected as shown below:

In column 7, line 23, after the word containing, insert --hydrogen sulfide, methyl mercaptan--.

Signed and Sealed this

Twenty-third Day of January, 1996

*Attest:*

*Attesting Officer*

Bruce Lehman

BRUCE LEHMAN

*Commissioner of Patents and Trademarks*